United States Patent [19]

Nirmel

[11] Patent Number: 5,076,612

[45] Date of Patent: Dec. 31, 1991

[54] SYSTEM AND METHOD FOR ACCURATELY LOCATING OBJECTS OF ASSORTED SHAPES AND SIZES ON A SUBSTANTIALLY VERTICAL SUPPORTING SURFACE

[76] Inventor: Chittaranjan N. Nirmel, 1108 Portner Rd., Alexandria, Va. 22314

[21] Appl. No.: 606,147

[22] Filed: Oct. 31, 1990

[51] Int. Cl.[5] ..... B42D 15/00

[52] U.S. Cl. ..... 283/67

[58] Field of Search ..... 283/67, 115, 117, 70; 428/346, 42, 352, 542.8; 40/628, 630

[56] References Cited

U.S. PATENT DOCUMENTS 4,499,130 2/1985 Questel et al. .

4,936,606 6/1990 Moss ..... 283/70

*Primary Examiner*—Timothy V. Eley

*Assistant Examiner*—William Fridie, Jr.

*Attorney, Agent, or Firm*—Chittaranjan N. Nirmel

[57] ABSTRACT

A thin, flexible, elongate sheet is marked on one side, preferably with sets of intersection lines and has through apertures formed at selected intersections of these lines, the other side of the sheet being provided with a thin coating of a pressure responsive, readily releasable, adhesive at least immediately around the apertures. An edge portion of the sheet is defined by a line of closely spaced fine perforations along and spaced from an edge portion of the sheet, to thereby define an elongate narrow portion having the plurality of evenly spaced-apart apertures. The edge portion can be torn off at the perforations to provide an elongate ribbon-like segment of the sheet. In both aspects, the elongate ribbon-like material is lightly pressed to a wall surface to provide an easily movable and removable reference for placing a nail, screw or other object-supporting means on the wall. An extended length of the sheet is placed on a substantially horizontal work surface with the adhesive side lowermost. An object is placed on the marked surface of the sheet and its outline is marked on the sheet. The sheet is then cut as marked, to generate a shape replicate releasably attachable to the supporting wall with or without the use of a ribbon as described. The user may freely move a plurality of the corresponding shape replicates on the wall in order to visualize with accuracy the orientation, location and distribution of corresponding objects. The user may then utilize the markings and/or the apertures in the shape replicate to determine suitable locations for nails, screws or the like to support the various objects as desired.

21 Claims, 1 Drawing Sheet

SYSTEM AND METHOD FOR ACCURATELY LOCATING OBJECTS OF ASSORTED SHAPES AND SIZES ON A SUBSTANTIALLY VERTICAL SUPPORTING SURFACE

TECHNICAL FIELD

This invention relates to supporting of a number of objects on a support surface accurately and in harmony with other nearby objects and, more particularly, to a system and a method enabling a user not possessed of particular dexterity or strength to comfortably simulate the disposition of various objects on, for example, a substantially vertical wall with considerable realism until he or she determines the most satisfactory locations for the individual objects as part of a harmonious whole.

BACKGROUND ART

People often encounter situations, e.g., when they move into a new dwelling or office, where they want to hang up on one or more walls framed pictures, diplomas or certificates of generally rectangular shape or oddly shaped objects such as decorative clocks and the like. It is natural to want to locate such objects harmoniously with each other and with other features such as windows, counters, furniture, light switches or thermostat controls, and features such as areas of different textures, e.g., partially wall-papered or brick-veneered walls. The truth is that most people have a very hard time deciding exactly where individual objects are best located and, after experiencing considerable frustration, they usually settle on some less than totally satisfactory compromise solution. Even when one expends considerable time and energy in determining exactly where a number of objects such as rectangular and generally similarly shaped framed diplomas or pictures are to be hung, very often the objects do not finally line up with each other accurately and harmoniously. This happens because for most people it is quite difficult to accurately locate a nail, screw or other means for supporting the load of each individual object as intended.

The common technique, although one which tends to frustrate even persons skilled in visualizing, measuring and manipulating objects, e.g., engineers, architects and the like, is to use a measuring tape or yardstick and make small pencil marks on the painted or wall-papered surface of a wall where nails or screws are to be driven to support objects. The objects are individually held up and moved around by a friend or colleague, while the person trying to locate the object tries to visualize and remember how the individual objects are meant to be located. Sometimes a wall surface does not readily lend itself to marking in this manner, e.g., if it is a brick veneered wall, has flocked wall paper, or has an expensive or fragile covering such as silk or straw.

There exists a clear need for a system and a method that may be readily employed by an average person, who possesses only basic tools and measuring devices and finite patience, who wishes to locate on one or more substantially vertical support surfaces a plurality of differently shaped and sized objects with the freedom to quickly and comfortably visualize with a high degree of accuracy how the objects will fit into their surroundings and with each other.

DISCLOSURE OF THE INVENTION

Accordingly, it is a principal object of this invention, in its various embodiments, to provide a simple and inexpensive system for quickly and conveniently generating easily-relocatable overall shape replicates of a number of objects of varying shapes and sizes, to enable a person to repeatedly relocate the replicates on one or more substantially vertical support surfaces, to thereby determine satisfactory locations for the various objects corresponding to the shape replicates.

In another aspect of this invention, there is provided a method for using an inexpensive and convenient-to-handle thin sheet to produce therefrom accurate overall shape replicates of a plurality of objects in a repeatedly relocatable manner, to thereby enable a user to determine satisfactory and harmonious locations for the various objects vis-a-vis other nearby objects.

In a preferred embodiment of this invention, there is provided a system for determining a location on a supporting surface for mounting an object thereat in harmonious relations with other objects and features near the supporting surface, the system comprising:

a thin, elongate sheet of a flexible material, provided at a first side with visible reference marks; and pressure responsive and easily releasable adhesive means provided at selected portions of a second side of said sheet, said sheet being formed with a plurality of through apertures disposed in correspondence with said reference marks, said adhesive means being disposed at least around said apertures to facilitate releasable adherence of said sheet to the support surface immediately around said apertures, whereby a shape replicate of the object formed from said sheet may be temporarily adhered to the supporting surface to enable determination of said mounting location.

In another aspect of this invention, there is provided a method for locating an object on a supporting surface in harmonious relationship with other objects and features near said supporting surface, comprising the steps of:

extending a thin elongate sheet of material that has reference marks on a first side, a pressure-responsive and easily releasable adhesive applied to selected portions of a second side, and through apertures disposed in correspondence with said reference marks, with said second side of said sheet contacting a substantially horizontal working surface;

placing an object, having a front intended to be visible and a rear intended to be adjacent to said supporting surface when said object is supported thereby, on said first side of said elongate sheet;

marking an outline of said object on said first side of said sheet in a predetermined correspondence with respect to said marks thereon;

cutting said sheet according to said marked outline to thereby produce a shape replicate of said object; and releasably adhering said shape replicate at a selected location on said supporting surface, and adjusting said selected location to thereby determine a location for said object in a harmonious relationship with other objects and features nearby.

In yet another aspect of this invention, there is provided a device for locating objects on a supporting surface in harmonious relationship with other objects and features near the supporting surface, comprising:

a thin, elongate sheet of a flexible material, provided at a first side with visible reference marks; and pressure responsive and easily releasable adhesive means provided at selected portions of a second side of said sheet, whereby at least a portion of said second side immediately adjacent an edge of the elongate sheet is free of adhesive, said sheet being formed with a plurality of through apertures disposed in correspondence with said reference marks, said adhesive means being disposed at least around said apertures to facilitate releasable adherence of said sheet to the support surface immediately around said apertures.

In an even further aspect of the invention, there is provided a system for determining a location on a supporting surface for mounting an object thereat in harmonious relationship with other objects and features near the supporting surface, the system comprising:

a thin, elongate sheet of a flexible material, provided at a first side with visible reference marks; and pressure responsive releasable adhesive means provided at selected portions of a second side of said sheet, said sheet being formed with at least one through aperture disposed in correspondence with said reference marks, said adhesive means being disposed at least around said at least one aperture to facilitate adherence of said sheet to the support surface at least around said at least one aperture, whereby a shape replicate of the object formed from said sheet may be temporarily adhered to the supporting surface to enable determination of said mounting location.

DESCRIPTION OF THE PREFERRED EMBODIMENTS

The preferred embodiment of the system according to this invention takes the form of a thin, flat, elongate sheet of a flexible material most conveniently handled as a roll, e.g., like a roll of wallpaper.

One side of the sheet, referred to hereinafter as the "marked side", preferably has printed thereon a plurality of fine but distinct lines separated at predetermined intervals to form a generally grid-like pattern. The opposite side of the sheet, referred to hereinafter as the "adhesive side", has applied to selected portions thereof a thin layer of a readily releasable adhesive, i.e., an adhesive that is firmly adhered to the sheet and has the ability to adhere to an object to which the sheet is pressed with the releasable adhesive in contact with the surface to which temporary releasable adhesion is desired.

One commercially available product that utilizes such releasable adhesive, in a different structure but for somewhat similar purposes as the present invention, is marketed by the 3M Commercial Office Supply Division of St. Paul, Minn., as a pad of self-stick removable notes under the trademark "Highland".

A more detailed description of important features and aspects of preferred embodiments of the system will now be described with reference to FIG. 1-5.

Figure 1:
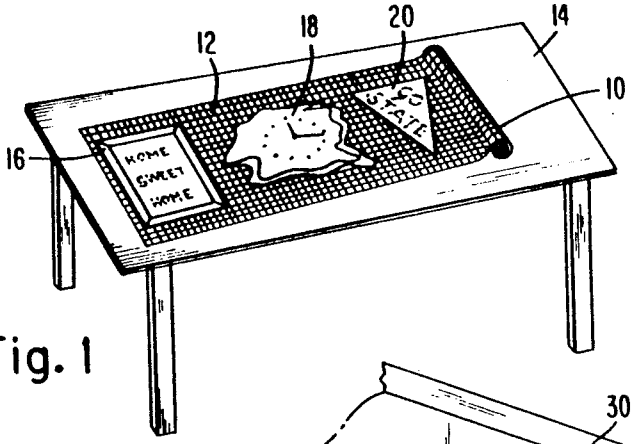
FIG. 1 illustrates an initial step in using both the system and the method according to a preferred embodiment of the invention.

As best understood with reference to FIG. 1, a roll of a flat elongate sheet 10 has, in a preferred embodiment, an orthogonal grid of fine lines 12 printed on its marked surface. As manufactured and stored prior to use, the marked surface is at the outside of the roll. During use, a length of the roll is unwound and, most conveniently, laid flat on a work surface 14, e.g., the top of a dining room table, a desk or the like, with the marked surface uppermost so that grid 12 is visible. Work surface 14 should be substantially flat, dry and free of dust or dirt that may tend to adhere to the releasable adhesive provided at the adhesive side of the sheet.

For convenience of marketing, handling, and general use, the sheet 10 may be formed in a width of, for example, ½ inch to 4 feet and a length preferably in the range of 2 to 100 feet. Obviously, depending upon the circumstances of its use, the sheet-like material may be produced, stored, transported and used in other ways, widths and lengths.

Once a suitable length of the sheet 10 is laid out on work surface 14, objects of interest are laid with their respective back surfaces immediately over grid 12. As illustrated in FIG. 1, these objects typically may include generally rectangular framed pictures, diplomas or the like 16, irregularly shaped and substantially three-dimensional objects such as a randomly shaped wall-clock 18, or a generally flat non-rectangular object 6 such as a college pennant 20. In short, such objects may be of almost any shape, and their so-called "back surfaces" are the surfaces that are intended to be closest to the wall that will eventually support them. These back surfaces of the objects are laid on the marked surface of the rolled out sheet-like material 10.

The user may find it advantageous to line the objects with respect to grid 12 in such a manner that each object as laid on the grid is in a meaningful correspondence with the intersecting lines forming grid 12. Having done this, the user employs any convenient known marking means, e.g., a pencil, a pen or the like, to outline on the marked surface of sheet 10 an outline of the object. When a number of objects are to be supported, the user may work with one object at a time, taking care to avoid overlapping the marked projections of the shapes of the individual objects on the grid.

The presence of adhesive on the lower side of the sheet 10 helps maintain it in place on the work surface 14. Accordingly, even if individual objects are somewhat heavy or awkward to hold, once the user deposits them on the marked surface of the rolled-out sheet 10, he or she may comfortably slide the object on the marked surface for optimum location of the object with respect to the lines of grid 12. Once the various outlines of objects, e.g., rectangular frame 16, oddly shaped clock 18, and triangular pennant 20, are drawn, the user removes the individual objects. With any conventional means, e.g., a pair of scissors or a sharp cutting blade, the user then carefully cuts out the marked shapes to serve as "shape replicates" of the various objects.

Figure 2:
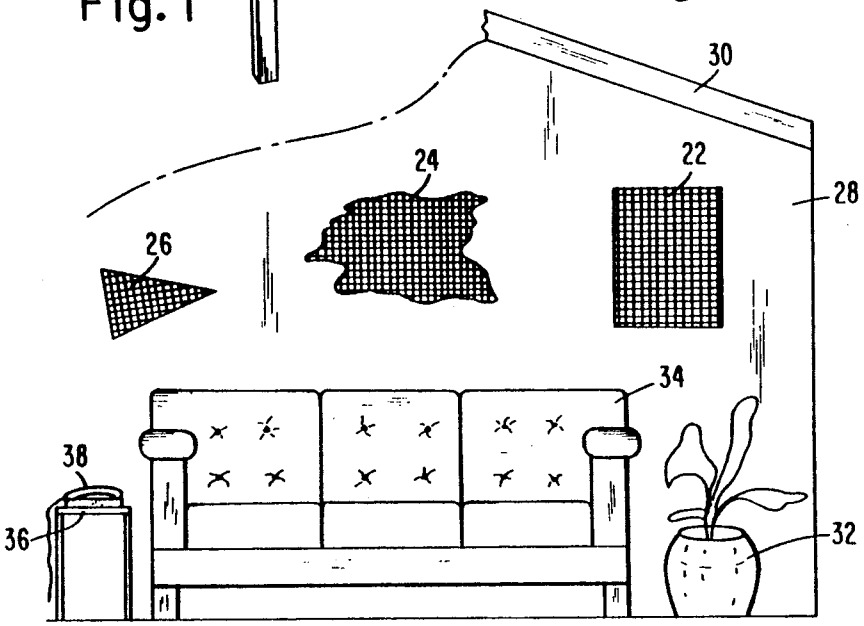
FIG. 2 illustrates a later step in using the system and the method according to the preferred embodiment per FIG. 1.

Referring now to FIG. 2, it will be readily seen that shape replicates 22, 24 and 26 respectively correspond to objects 16, 18 and 20 illustrated in perspective view in FIG. 1.

FIG. 2 is intended to be a partial elevation view of a supporting wall 28 underneath an exemplary sloping beam 30 in a corner of a room that also contains, for example, a potted plant 32, a sofa 34, an occasional table 36, and a telephone 38 resting on table 36. As will be readily understood and appreciated, there may also be other walls, alcoves and other architectural features, light switches, thermostat controls, already mounted pictures and other objects (not shown for simplicity), and the like. These, together, will hereinafter be referred to as "the surroundings". It is within these surroundings that objects such as 16, 18 and 20 are to be mounted to the wall in a harmonious manner.

As illustrated in FIG. 2, the user picks up the individual shape replicates 22, 24 and 26, each of which is very light and easy to handle, and then presses the adhesive side of the shape replicates to the wall on which the respective objects are to be eventually mounted. Because the shape replicates are provided with a readily releasable adhesive, the user merely has to lightly press each shape replicate to the wall 28 surface to obtain adequate temporary adherence thereat. In this manner, the user can try out different locations for the various shape replicates, and view them comfortably while standing back at a distance, without having to depend on someone else to hold the individual objects, in order to determine the overall impact of different dispositions of the objects.

As is clear from FIG. 2, even oddly shaped objects such as irregularly shaped wall-clock 18, when represented by its corresponding shape-replicate 24, can be visualized in proper correspondence with the local horizontal, i.e., a direction essentially parallel to a floor supporting adjacent furniture, and the local vertical normal thereto. Then, when a shape replicate is replaced by the corresponding object, that object will be in harmonious relationship with the floor and walls of the surroundings.

Objects like triangular pennant 20 may be disposed in a preferred angular relationship with respect to the local vertical and the local horizontal. This is generally indicated in FIG. 2, i.e., the grid lines of shape replicate 26 are not necessarily parallel to the grid lines of shape replicate 22. Likewise, there is no necessity that shape replicate 22 be disposed with its grid lines parallel to the local horizontal and/or vertical.

As already noted, because each of the shape replicates is true in size and outline to a specific object, a user may place the original objects within sight, e.g., on the sofa 34 (although not so shown in FIG. 2 for simplicity), while moving the shape replicates from place to place on wall 28 to get a realistic idea of what the most harmonious distribution of the objects will eventually be.

Note that this activity can be interrupted at any time without inconvenience. For example, if the user is moving the shape replicates around and the telephone rings, the user can interrupt his or her activity and immediately address the telephone call without having to worry about first placing a heavy, fragile or awkwardly-shaped object in a safe location.

Likewise, if a family or group of persons is sharing in this activity, the suggestions and opinions of the individual members present can be readily tried out, considered and critiqued without running the risks of mishandling or damage to the individual objects. This should encourage participation by all present, including children, give them the opportunity to have their ideas considered, and generally add to the harmony obtained by an informed and meaningful consensus.

Before proceeding to a description of the manner in which fixing means may be applied to the supporting wall surface to physically support the actual objects visually represented by their respective shape replicates in the process so far, it will be helpful to understand how particular advantages may be obtained by selecting the markings and overall form of the sheet 10 from which the shape replicates are cut.

Figure 3:
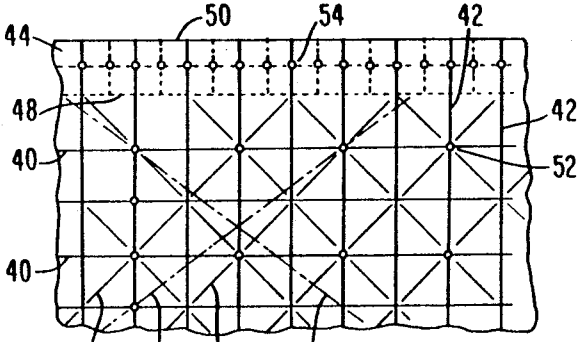
FIG. 3 is an illustration of certain principal elements of the system according to a preferred embodiment of this invention.

Referring now to FIG. 3, it will be readily seen that for the bulk of the marked surface 12 it may be most convenient to provide sets of parallel lines 40 and 42 intersecting orthogonally. As illustrated, parallel lines 40 are preferably oriented along the length of the elongate sheet 10, as best seen in FIG. 1.

In a preferred embodiment of this invention, an edge portion 44 may be defined by a line 48 parallel to lines 40 and spaced at a predetermined distance from edge 50. As is well known, elongate sheet-like lengths, e.g., paper used with word processing printers moved by positive drive means, are typically provided with apertured edge portions defined by a line of closely spaced very fine perforations. One example of this is printing paper marketed as "Microperf". Such a known technique may be used to define edge portion 44 of a predetermined width, e.g., conveniently in the range $\frac{1}{3}$–1 inch by providing fine closely-spaced perforations along line 48.

Furthermore, a plurality of apertures 52 may be provided at the intersections of the sets of lines 40 and 42, as best seen in FIG. 3. Similar apertures 54 may also be provided, preferably to a greater density, midway across the width and along the length of edge portion 44, also as illustrated in FIG. 3. Even further, a plurality of inclined lines 56, 56 parallel to each other and passing through the intersections of lines 40 and 42, may be provided for reasons to be discussed more fully hereinafter. These lines 56 are illustrated in FIG. 3 as being inclined at 45° to the sets of intersecting lines 40 and 42. In yet another option, additional lines 58, 58 may also be provided inclined at 30° with respect to edge 50, these being provided in a different color for ease of reference.

It will now be apparent that the distribution of marking lines such as 40, 42, 56 and 58 is relatively arbitrary and may be modified as most appropriate to suit specific needs. Likewise, the density and distribution of apertures such as 52 and 54 are also optional matters to suit specific needs for the system.

On the adhesive side, i.e., on the opposite side from the marked side discussed in the immediately-preceding paragraphs, a releasable adhesive is provided in a fine coating over a sufficient portion of the area to ensure adequate adhesiveness, especially around the apertures, to most commonly-encountered surfaces. The term "releasable adhesive" is intended to refer to any known adhesive material which does not have to be moistened for use, has a long shelf life, is relatively inexpensive, has a preference for strongly adhering to the material of sheet 10 and forms a relatively weak adhesive bond when pressed to common wall surfaces, e.g., a painted surface, a wood panel, or wall papered surface. Commercially-available examples of such materials are well known and are discussed in, for example, U.S. Pat. No. 4,499,130, to Questel et al., incorporated herein by reference for its teaching of such adhesive materials. Likewise, the provision of such releasable adhesive to selected portions and in selected patterns on small pieces of note paper is taught in U.S. Statutory Invention Registration, Registration No. H377, to Greig, published Dec. 1, 1987, the same being incorporated herein by reference.

Figure 4:
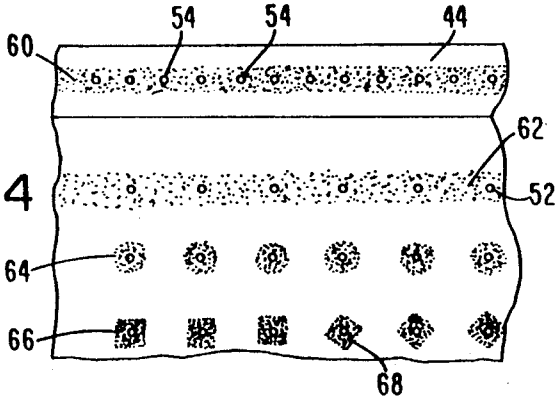
FIG. 4 illustrates details of various options for distributing a low-tack adhesive on a reverse side of an element illustrated in FIG. 3.

As best seen in FIG. 4, such a releasable adhesive may be provided conveniently in a band 60 surrounding apertures 54 and extending along the length of edge portion 44, but not extending across the entire width thereof. For the portions of sheet 10 away from edge portion 44, the releasable adhesive may be provided in any of various alternatives. In a first alternative, the adhesive may be provided in a band 62 generally similar to the band 60, but surrounding and extending along the line of through apertures 52.

In other alternatives, as also illustrated in FIG. 4, the releasable adhesive may be provided in circular areas 64, square areas 66 oriented with their sides aligned with sides 40 and 42 on the opposite side of the sheet-like material 10, or as diamond or rhombus shapes 68 with their sides aligned with sides 56, 56 on the opposite side of sheet-like material 10.

From considerations of economy, as well as convenience in eventually releasing the shape replicates from the surface of wall 28, adhesive bands 60 and 62 may conveniently have widths in the range $\frac{1}{8}$–$\frac{1}{2}$ inch, and patches 64, 66 and 68 may have transverse dimensions within the same range.

As will be readily understood, when a shape replicate such as 22, 24 or 26 is cut and applied to a surface such as 28, it should be made convenient for the user to simply peel away the shape replicate by a gentle pull on an edge thereof in order to position it elsewhere or to eventually discard it. Even in a simple rectangular location, such as a corner of a room, the user may find it helpful to have a single, easily markable horizontal reference at a selected height above the floor. In the preferred embodiment discussed hitherto, with the line of fine perforations 48 provided to define the edge portion 44, the user may simply tear off a length of edge portion 44 from the roll of sheet 10, without disturbing the rest of the material. Since this ribbon-like portion 44 has its own band of adhesive 60 along and about the line of apertures 54, even a long piece of portion 44 can be readily stretched out and temporarily adhered to wall surface 28.

Such a length of temporarily adhered strip-like element 44 need not be disposed horizontally, but may be applied as desired. Thus, for example, if one is seeking to mount pictures or objects around and upwardly along a central pillar in conjunction with a spiral walkway or staircase (as may happen in some modern museums), such a length of strip 44 may be disposed in a spiral manner thereon. Likewise, e.g., in an airport having long ramps or by the side of long escalators in subway systems, such a strip 44 may be temporarily adhered in predetermined relationship to adjacent structural features, e.g., at the same inclination as the ramp or escalator hand rail. Once such a strip 44 is thus applied, it may be utilized as most appropriate in aligning and disposing, partially thereover as appropriate, various shape replicates such as 22, 24, and 26.

Figure 5:
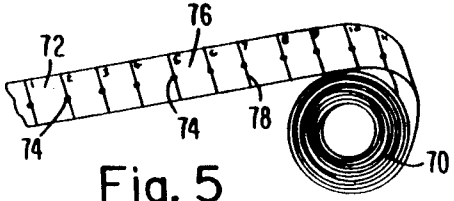
FIG. 5 illustrates an optional form for the principal element according to another embodiment of this invention.

As a practical matter, and where extended lengths of such a strip may be needed for reference purposes, it may be most convenient to produce the same as its own roll 70, best seen in FIG. 5. The sheet 10 is then available as a ribbon 72 of a predetermined width, e.g., in a range $\frac{1}{4}$–1 inch, with a plurality of through apertures 74 and marking lines 76 and 78. Additional markings such as, for example, numerals periodically metered to indicate centimeters or inches of length may be repeated at every meter or yard for reference by the user. Apertures 74 are illustrated in FIG. 5 as being present at the intersections of elongate line 76 disposed lengthwise of ribbon 72 and transverse lines 78 normal thereto. As will be readily apparent, other line markings as previously discussed may also be provided. Such ribbons 72 may be sold individually as rolls 70 in convenient lengths.

Quite apart from their hitherto-discussed utility for serving as elongate references for use in conjunction with shape replicates, there is yet another way in which such elongate ribbon-like elements such as 72 may be utilized for the purposes of this invention. Thus, for example, if a rectangular object such as 16 were very large, one could use overlapping pieces of the sheets like sheet 10. This, however, could prove quite wasteful of the material. A much more economical alternative would be to utilize lengths of strip-like material 72 initially applied along the outside edges of a large object turned upside-down. The ribbon-like lengths along the edges of the object would meet, intersect and releasably adhere to each other at these intersections to define the overall outline of the object. Thus, for example, if framed object 16 had dimensions considerably larger than the width of sheet-like element 10, by applying suitable lengths of ribbon-like elements 72 along the edges theeof, and by obtaining temporary adherence of the intersecting lengths at the corners of the object, one would have an outline defining the shape and size of the object in question. This hollow rectangular ribbon-like shape may then be utilized in the same manner as previously-discussed shape replicates 22, 24 and 27. This is most conveniently done for regularly shaped objects, e.g., rectangles or triangles, but the principle is generally applicable to other shapes comprising one or more basic shapes.

The system and method of the present invention have utility beyond merely enabling a user to visualize the general appearance of a plurality of objects vis-a-vis their intended surroundings. It is very important for the user to be able to securely attach each of the objects at its intended location and in its intended orientation. It is helpful to consider a variety of examples in this regard. Consider first a rectangular picture or mirror in a wooden frame that has driven into the back thereof, on opposite vertical sides, two nails or screws to which a length of wire is attached, it being intended that the wire would be supported generally centrally by a nail or screw driven into a vertical wall. Once the user has cut out the appropriate replicate shape, if the object has a symmetrical shape, e.g., a rectangular picture such as 16, the user may most conveniently turn the object so that its front is lowermost on work surface 14, then lay the corresponding replicate shape, with its marked side uppermost on the back surface of the framed picture, and with a pencil easily mark where a supporting nail must support the stretched-out wire. If this coincides with one of the apertures 52, the user may simply draw a circle around that aperture. If the optimum position for a supporting nail is to be at a location other than one of the provided apertures 52, the user may mark the nearest intersection of lines 40 and 42 in obvious manner. Then, once the proper location for shape replicate 22 corresponding to the rectangular object 16 is determined, the user will know precisely where to drive in a nail or drill a hole in the support surface, prferably through an aperture of the shape replicate to locate a screw, with or without an initially placed plastic insert or the like, to eventually support the object as intended.

As persons of ordinary skill in the relevant art will immediately appreciate, the use of ribbon-like, edge portions 44 from a roll 10, or a length of ribbon 72 per FIG. 5, also lends itself to the marking of locations for drilling of holes to mount screws to a wall or the driving of nails to thereafter support intended objects.

With an understanding of the description provided hitherto, the method of this invention will be readily understood. Essentially, it requires a user to mark on and cut a shape replicate from a sheet-like element of a material that is marked with a predetermined pattern on a marked side and is provided with areas of a back surface coating with a readily-releasable adhesive, releasably mounting the shape replicate to a supporting surface by pressure applied to the releasable adhesive, and thereby determining and optimal location for an object corresponding to the shape replicate, harmonious location with respect to its intended surroundings. Optionally, the user may also utilize with the shape replicates itself or a ribbon-like piece of the sheet marked on one side and provided with coating of a releasable adhesive on the other.

In this disclosure, there are shown and described only the prefered embodiments of the invention, but, as aforementioned, it is to be understood that the invention is capable of use in various other combinations and environments and is capable of changes or modifications within the scope of the inventive concept as expressed herein.

What is claimed is:

1. A system for locating objects on a supporting surface in harmonious relationship with other objects and features near the support surface, the system comprising:

a thin, elongate sheet of a flexible material, provided at a first side with visible reference marks; and pressure responsive releasable adhesive means provided at selected portions of a second side of said sheet, said sheet being formed with at least one through aperture disposed in correspondence with said reference marks, said adhesive means being disposed at least around said at least one aperture to facilitate releasable adherence of said sheet thereat to the supporting surface.

2. The system according to claim 1, wherein:

said sheet has a predetermined width in a range ½ inch to 4 feet and a length in the range 2 feet to 100 feet.

3. The system according to claim 1, wherein:

said reference marks include a first set of mutually parallel lines; and a second set of mutually parallel lines intersecting said first set of mutually parallel lines at least at said at least one aperture.

4. The system according to claim 3, wherein:

said first set of mutually parallel lines is oriented normal to a lengthwise edge of the sheet.

5. The system according to claim 3, wherein:

said first set of mutually parallel lines is oriented to be inclined at a predetermined angle with respect to a lengthwise edge of the sheet.

6. The system according to claim 4, further comprising:

at least one other set of mutually parallel lines oriented to be inclined at a predetermined angle with respect to said lengthwise edge of the sheet.

7. The system according to claim 3, wherein:

said reference marks comprise numerals disposed adjacent individual lines of said first set of parallel lines near a lengthwise edge of the sheet.

8. The system according to claim 7, wherein:

said numerals are provided in repeated sets.

9. The system according to claim 1, wherein:

an edge portion of said sheet in a lengthwise direction thereof is defined by a line of closely spaced fine perforations, thereby defining a tear-off line, said tear-off line being parallel to an adjacent edge of the sheet at a predetermined separation therefrom.

10. The system according to claim 9, wherein:

said separation between said perforation line and said adjacent edge is in the range ¼ inch to 1 inch.

11. The system according to claim 1, wherein:

said adhesive means comprises a thin layer of adhesive material applied to said second side, said adhesive material being selected and applied to adhere strongly to said second side, to also adhere to said support surface when said second side of said elongate sheet is pressed thereto, and to readily release from said support surface when said elongate sheet is pulled away from said support surface.

12. The system according to claim 11, wherein:

said adhesive is disposed to extend as a band that extends around and between each aperture in a selected line of apertures.

13. The system according to claim 12, wherein:

said band of adhesive is narrower in width than said elongate sheet.

14. The system according to claim 1, wherein:

said sheet comprises paper.

15. A method for locating an object on a supporting surface in harmonious relationship with other objects and features near said supporting surface, comprising the steps of:

extending a thin elongate sheet of material that has reference marks on a first side, a pressure-responsive and easily releasable adhesive applied to selected portions of a second side, and through apertures disposed in correspondence with said reference marks, with said second side of said sheet contacting a substantially horizontal working surface;

placing an object, having a front intended to be visible and a rear intended to be adjacent to said supporting surface when said object is supported thereby, on said first side of said elongate sheet with said front visible;

marking an outline of said object on said first side of said sheet in a predetermined correspondence with respect to said marks thereon;

cutting said sheet according to said marked outline to thereby produce a shape replicate of said object; and releasably adhering said shape replicate at a selected location on said supporting surface, and adjusting said selected location to thereby determine a location for said object in a harmonious relationship with other objects and features nearby.

16. The method according to claim 15, comprising the further step of:

placing said shape replicate in conjunction with the corresponding object and marking on said shape replicate selected positions for locating object support means for supporting said object at said support surface; and attaching surface support means to said support surface, in correspondence with said marking made on said shape replicate, to cooperate with said object support means to support said corresponding object.

17. The method according to claim 16, wherein:

said step of attaching said surface support means to said support surface comprises the step of drilling a hole into said support surface through said shape replicate applied thereto.

18. The method according to claim 16, comprising the further step of:

applying a narrow strip-like element of said elongate sheet to said support surface; and thereafter applying one or more individually formed shape replicates to said support surface in correspondence with said strip-like element, to thereby determine a harmonious relationship for locating a plurality of corresponding objects on said support surface.

19. The system according to claim 15, wherein:

said sheet comprises paper.

20. A device for locating objects on a supporting surface in harmonious relationship with other objects and features near the supporting surface, comprising:

a thin, elongate sheet of a flexible material, provided at a first side with visible reference marks; and pressure responsive releasable adhesive means provided at selected portions of a second side of said sheet, whereby at least a portion of said second side immediately adjacent an edge of the elongate sheet is free of adhesive, said sheet being formed with a plurality of through apertures disposed in correspondence with said reference marks, said adhesive means being disposed at least around said apertures to facilitate releasable adherence of said sheet to the support surface immediately around said apertures.

21. A system for determining a location on a supporting surface for mounting an object thereat in harmonious relationship with other objects and features near the supporting surface, the system comprising:

a thin, elongate sheet of a flexible material, provided at a first side with visible reference marks; and pressure responsive releasable adhesive means provided at selected portions of a second side of said sheet, said sheet being formed with at least one through aperture disposed in correspondence with said reference marks, said adhesive means being disposed at least around said at least one aperture to facilitate releasable adherence of said sheet to the support surface at least around said at least one aperture, whereby a shape replicate of the object formed from said sheet may be temporarily adhered to the supporting surface to enable determination of said mounting location.

* * * * *